US005415562A

United States Patent [19]

Matsumoto et al.

[11] Patent Number: 5,415,562

[45] Date of Patent: May 16, 1995

[54] PRESSURE WELDING CONNECTOR

[75] Inventors: Mitsuhiro Matsumoto; Satoshi Yamada, both of Shizuoka, Japan

[73] Assignee: Yazaki Corporation, Japan

[21] Appl. No.: 120,366

[22] Filed: Sep. 14, 1993

[30] Foreign Application Priority Data

Sep. 14, 1992 [JP] Japan ..... 4-064108 U

[51] Int. Cl.[6] ..... H01R 4/24; H01R 13/506; H01R 13/58

[52] U.S. Cl. ..... 439/397; 439/399; 439/417; 439/711

[58] Field of Search ..... 439/395–407, 439/417, 711, 719

[56] References Cited

U.S. PATENT DOCUMENTS

| | | | |
|---|---|---|---|
| 3,718,888 | 2/1973 | Pasternak | 439/399 |
| 3,890,029 | 6/1975 | Izraeli | 439/402 |
| 3,899,236 | 8/1975 | Santos | 439/402 |
| 3,936,128 | 2/1976 | D'Annessa et al. | 439/399 |
| 3,990,762 | 11/1976 | Lemesle | 439/395 |
| 4,344,665 | 8/1982 | Racilla et al. | 439/407 |
| 4,367,004 | 1/1983 | Fujiura et al. | 439/396 |
| 4,496,206 | 1/1985 | Markwardt et al. | 439/404 |
| 4,537,455 | 8/1985 | Vertenten et al. | 439/404 |
| 4,749,366 | 6/1988 | McCaffery | 439/396 |
| 4,822,299 | 4/1989 | Rider, Jr. | 439/402 |
| 4,826,449 | 5/1989 | DeBartoli et al. | 439/711 |
| 5,071,365 | 12/1991 | Fremgen et al. | 439/402 |
| 5,073,126 | 12/1991 | Kikuchi et al. | 439/397 |

FOREIGN PATENT DOCUMENTS

| | | |
|---|---|---|
| 62-128460 | 6/1987 | Japan . |
| 62-186475 | 8/1987 | Japan . |
| 63-112780 | 7/1988 | Japan . |
| 2-57563 | 4/1990 | Japan . |
| 3159077 | 7/1991 | Japan . |

*Primary Examiner*—Steven C. Bishop

*Attorney, Agent, or Firm*—Wigman, Cohen, Leitner & Myers

[57] ABSTRACT

Pressure welding terminals are disposed on terminal receiving portions of a housing. The pressure welding terminals are provided with expanded portions and press-fitting slots. The expanded portions are to receive the wires. The press-fitting slots are electrically connected with wires by press-fitting said wires. Temporarily holding portions are provided with flexible portions and wire holding holes. The flexible portions temporarily hold the wires in space between the expanded portions. The wire holding holes are formed on the housing and are capable of receiving tips of wires. The flexible portions are provided with pairs of lances and pairs of flexible wings. The lances extend from terminal receiving portions of the housing and disposed on both sides of the wires. The flexible wings extend from the lances and hold the wires in spaces between the inclined edges.

2 Claims, 7 Drawing Sheets

PRESSURE WELDING CONNECTOR

TECHNICAL FIELD

This invention relates to a pressure welding connector to be connected with a wire by pressure-welding.

BACKGROUND ART

A conventional pressure welding connector is shown in, for example, Japanese Patent laid-open (Kokai) No. 3-159077.

This pressure welding connector is for use in a multi-conductor cable in which a housing has a plurality of pressure welding terminals therein. A pin portion protrudes from a main body of the pressure welding terminals and forwardly protrudes through a insulation wall on a rear end of the housing. The main body is located on a pressure welding work portion in the back of the insulation wall. A pair of pressure welding plates have spaces therebetween along a extending direction thereof and are mounted as a pressure welding portion on the main body of the pressure welding terminals. U-shaped pressure welding slots are formed in center of each pressure welding plate.

The outside of the housing is covered by a shield case. A shield crimp portion and a sheath holding portion are mounted on a rear end of the shield case. The shield crimp portion has a U-shaped pressure welding piece and the sheath holding portion has a U-shaped holding piece.

When connecting the shield electric wire to the pressure welding connector in above mentioned structure, an outer sheath and an outer conductor are peeled and then the covered wires which are disposed inside the outer conductors are aligned to be a plane and they are fixed with heat welding or taping.

Then, the insert tip of the covered wire is inserted into the pressure welding work portion at the upper side of the housing with maintaining its horizontal posture and the covered wire is located on the pressure welding slot of the pressure welding plate of the pressure welding terminal. At the same time, the outer conductor is inserted between the pressure welding pieces of the shield pressure welding portion. Also the outer sheath is inserted into space between holding pieces of the sheath holding portion.

Each sheath wire is press fitted into the pressure welding slot by using a pressure welding jig. Also, an outer conductor is crimped to the pressure welding pieces and an outer sheath to the holding piece by using another pressure welding jig, respectively.

In the above mentioned conventional pressure welding connector, there was no positioning means for exactly positioning the wire on the pressure welding slot when the wire is pressure welded by the pressure welding jig. Therefore, if the positioning is not exactly performed, the pressure welding can not be done perfectly and there is a possibility of damaging the reliability in an electrical connection.

The tip of the pressure welding jig is inserted into the space between a pair of pressure welding plates when pressure welding. When pulling out the pressure welding jig from the space after the pressure welding, the pressure welding jig is stuck to the pressure welding plates and the pressure welding terminal was pulled out together with the pressure welding jig when pulling out the pressure welding jig. As a result, there is a problem that the pressure welding terminal was lifted and bent at a medium portion.

SUMMARY OF THE INVENTION

It is an object of the invention to provide a pressure welding connector which can position an electric wire exactly on a pressure welding slot when pressure-welding.

It is another object of the invention to provide a pressure welding connector which can prevent the lifting of the pressure welding terminal when pulling out the pressure welding jig.

In accordance with this invention, there is provided a pressure welding connector for pressure welding wires comprising a housing which has terminal receiving portions. The pressure welding connector also has a pressure welding terminals mounted on the terminal receiving portions of the housing. The terminal receiving portions have expansion portions and press fit slots. The expansion portions are provided with wires. The press fit slots electrically connect with the wires by press fitting the wires. The pressure welding connector also has a temporary holding means which temporarily hold the wires before press fitting. The temporary holding means have flexible portions which temporarily hold the wires.

The pressure welding connector which has the above mentioned structure can press-fit wires into the pressure welding slots with great accuracy. This is because the temporary holding means temporarily holds the wires so that positioning of the wires can be performed properly when pressure-welding. Moreover, where the temporary holding means are mounted on the pressure welding portions, there can be prevented the terminals from lifting. This is caused by the pressure welding portions abutting against the temporary holding means when the pressure welding terminals are pulled together with the pressure welding jig.

DESCRIPTION OF THE PREFERRED EMBODIMENT

Embodiments of a pressure welding connector according to the present invention will be described with reference to the accompanying drawings hereinafter.

FIRST EMBODIMENT

Figure 1:
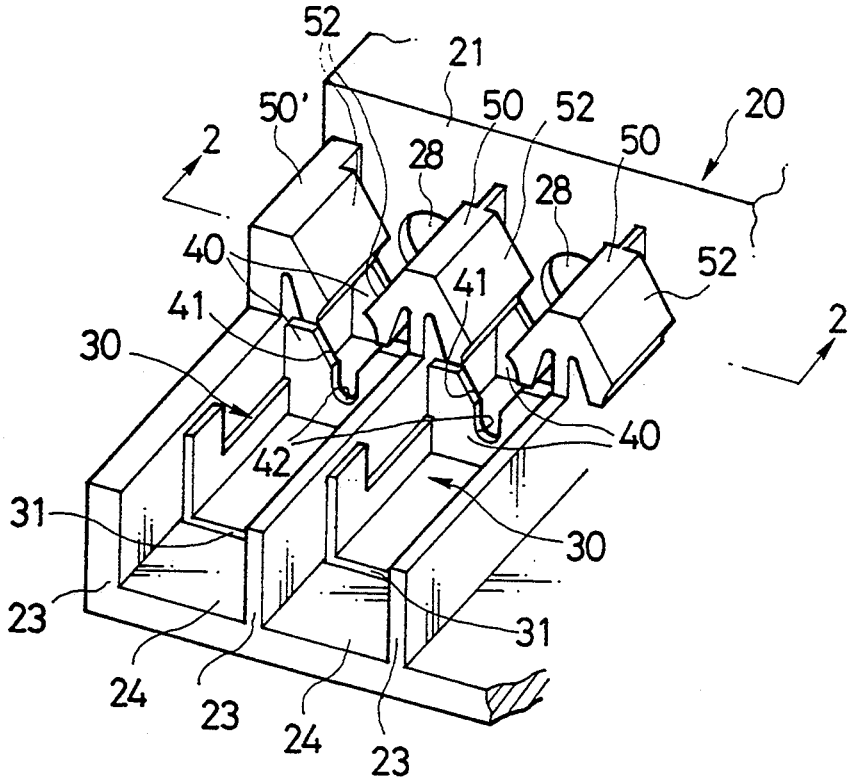
FIG. 1 is a perspective view showing a pressure welding connector regarding the first embodiment of the present invention.
Figure 2:
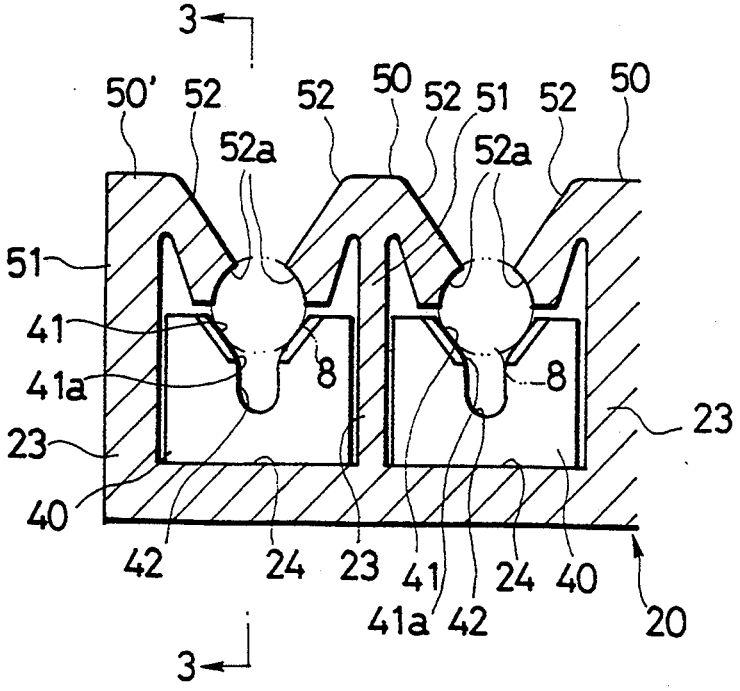
FIG. 2 is a sectional view taken substantially along the lines 2—2 of FIG. 1.
Figure 3:
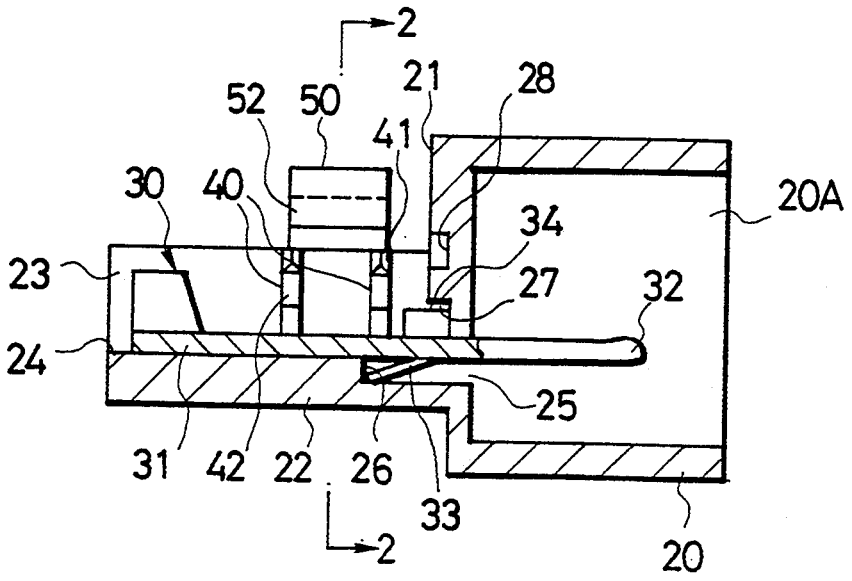
FIG. 3 is a sectional view taken substantially along the lines 3—3 of FIG. 2 showing the pressure welding connectors of FIG. 1.
Figure 4:
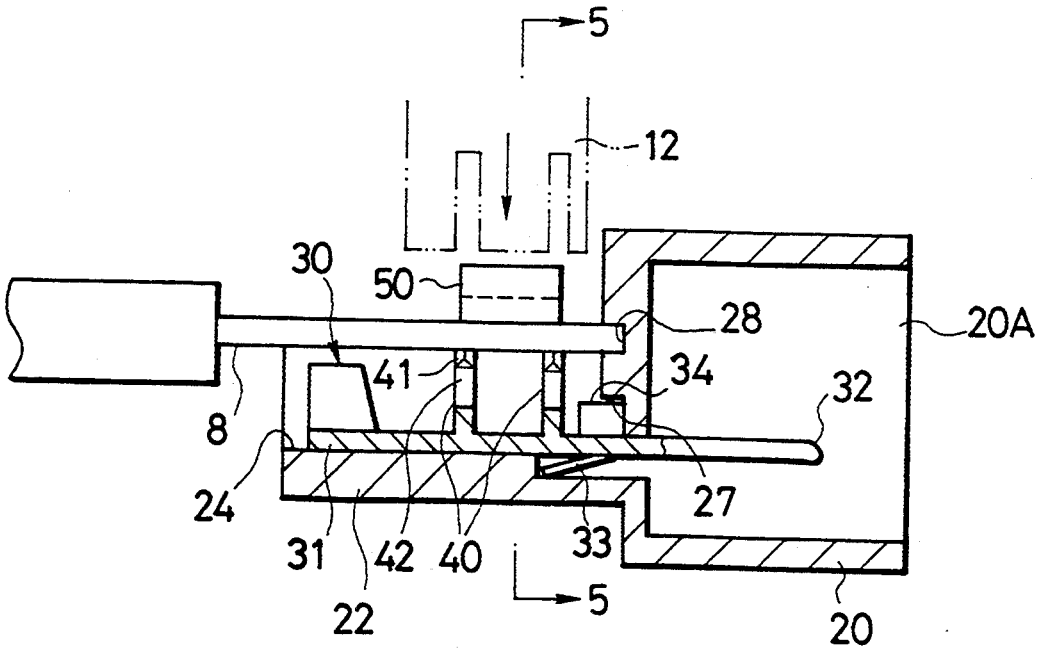
FIG. 4 is a sectional view taken substantially along the lines 4—4 of FIG. 5 showing a condition which setting wires to the pressure welding connector of FIG. 3 to temporarily hold the wires.
Figure 5:
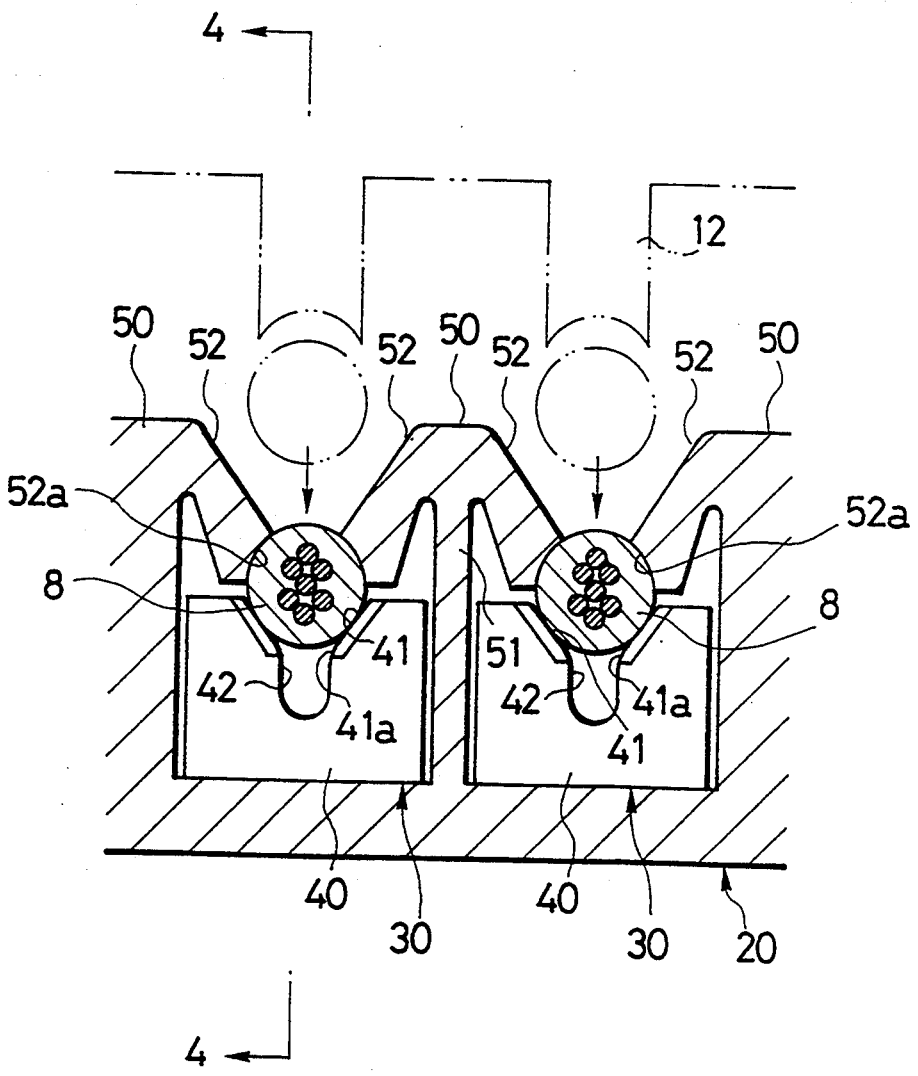
FIG. 5 is a sectional view taken substantially along the lines 5—5 of FIG. 4.

Referring to FIGS. 1, 2, 3, the pressure welding connector has a housing 20 in the front portion thereof. The housing 20 is made of resin and has a fitting hood 20A. The fitting hood 20A receives the other connector. Terminal receiving portion 22 is disposed on the rear portion of the housing 20 through a bulkhead 21. A plurality of terminal holding portions 24 are defined in the terminal receiving portions 22 by partition walls 23. Each terminal holding portion 24 has a channel shape which extends in a direction crossing to the bulkhead 21 (a longitudinal direction of wires 8 described hereinafter).

A pressure welding terminal 30 is inserted into each terminal holding portion 24 at the rear side thereof. The pressure welding terminal 30 has a main body 31 and a pin portion 32. The main body 81 is placed in the terminal holding portion 24. The pin portion 32 protrudes from a front end in a forward direction and passes through a through hall 25 and protrudes into the fitting hood 20A. Loose free recesses or tang recesses 26, 27 are formed on bottom and upper sides of the through hall 25. Loose free protrusions ortangs 83, 34 engage with loose free recesses or tang recesses 26, 27, respectively. Loose free protrusions or tang 33, 34 are mounted on a base of the pin portion 32 which is disposed on the pressure welding terminals 30. The tangs prevent looseness of the pressure welding terminals 30 in both forward and backward directions. One tang 33 is flexible.

A pair of pressure welding plates 40, 40 is integrally formed on the main bodies 31 of the pressure welding terminals 30. There is space between each pressure welding plate 40. A pair of pressure welding plates 40 is mounted in parallel and cross with a inserting direction of the pressure welding terminals 30. Pressure welding slot 42 is vertically formed in the center of the width direction of the pressure welding plate 40. As illustrated in FIG. 2, the pressure welding slot 42 has a U-shape and an expanded portion 41 is arranged on the upper end of-the pressure welding slot 42. The expanded portion 41 consists of a pair of inclined edges 41*a*. Each inclined edge 41*a* has a blade thereon.

Flexible lances 50, 50′ are formed integrally on upper ends of the partition walls 23 of the housing 20. The flexible lances S0, S0′ are placed above the pressure welding plates 40 and extend to overlap the plates 40. As shown in FIG. 2, each flexible lance S0, S0 has an wing or wings (a flexible temporary holding piece) which inclines downwardly and is mounted on both sides of vertical walls 51, respectively. The vertical walls S1 are disposed on the partition walls 23. Each flexible lance 50′ on the end portion has the flexible wing 52 only on one side.

A tip of the flexible wing 52 extends in a virtual position (shown in FIG. 2 with a chain double-dashed line) of the wire 8 when wire 8 is virtually positioned on expansion portion 41 of the pressure welding slot 42. On the surface of the tip of the flexible wing 52 is a working face 52*a* which extends around tile outer surface of the wire 8 in the virtual position. Each working face 52*a* is made of a curved surface or a slope which crosses in an extending direction of the flexible lances 50, 50′. The working face 52*a* faces the other working face 52*a* which is also made of a curved surface or a slope. An inclined edge 41*a* and the wire working face 52*a* are disposed so as to surround the wire 8 at four positions.

As shown in FIG. 3, the flexible lances 50, 50′ correspond to the spaces between the pressure welding plates 40, 40. Both ends of the flexible lances 50, 50′ overlap the pressure welding plates 40, 40. Therefore, the flexible wing 52 which extends downwardly from ends of the flexible lances 50, 50′ prevent the lifting of pressure welding plates 40. The flexible wing 52 may extend in a longitudinal direction.

Wire holding hole 28 is disposed on the rear face of the bulkhead 21 of the housing 20. The tip of the wire 8 in the virtual position is inserted into the wire holding hole 28. The wire holding hole 28 is positioned at a position where tip of the wire 8 touches when the wire 8 is placed on the expansion portion 41.

The description will now proceed to a function when the wire is pressure-welded to the pressure welding connector with the above-mentioned structure.

The wires 8 are aligned and brought down into a space between the flexible lances 50, 50′. By pressing the wire down into the space with manual operation, the flexible wings 52 of the flexible lances 50, 50′ are pressed by the wire 8 to be inwardly bent with stability and allows the wire 8 to pass through therebetween. After the passing through of the wire 8, the flexible wings 52 restore to the original state.

Thus, the wire 8 is accommodated in the space between the expansion portion 41 of the pressure welding slot 42 and the wire working faces 52*a* of flexible wings 52. Under these circumstances, the working faces 52*a* of the flexible wings 52 come in contact with the upper surface of the wire 8. Therefore, the flexible wings 52 prevent lifting of the wire 8, as well as the wire 8 is positioned and held therein. At the same time, the tip of the wire 8 is inserted into the wire holding hole 28 and held therein.

Next, in this condition, the pressure welding jig 12 goes down to press-fit the wire 8 into the pressure welding slot 42. All of press-fittings by the jig are performed simultaneously when all the wires 8 are set. By press-fitting, extends towards of the inclined edges 41*a* cut the cover and extends towards the inner conductor. Consequently, the wire 8 is press-fitted into the pressure welding slot 42, so that the conductor electrically connects with the pressure welding terminal 30.

As a result, the pressure welding could be performed with great accuracy because the wire 8 is previously temporarily held on the inclined edge 41*a* with the flexible wings 52. In addition, the press fitting into tile pressure welding slot 42 of the front pressure welding plate 40 can be performed accurately because the tip of the wire 8 is temporarily held in the wire holding hole 28. When lifting the pressure welding jig after the pressure welding, rising of the pressure welding terminals 30 can be certainly prevented. This is kept even if the pressure welding jig 12 is caught between the pressure welding plates 40 because parts of the flexible wings 52 of the flexible lances S0, S0′ are positioned over the pressure welding plates 40.

SECOND EMBODIMENT

Figure 6:
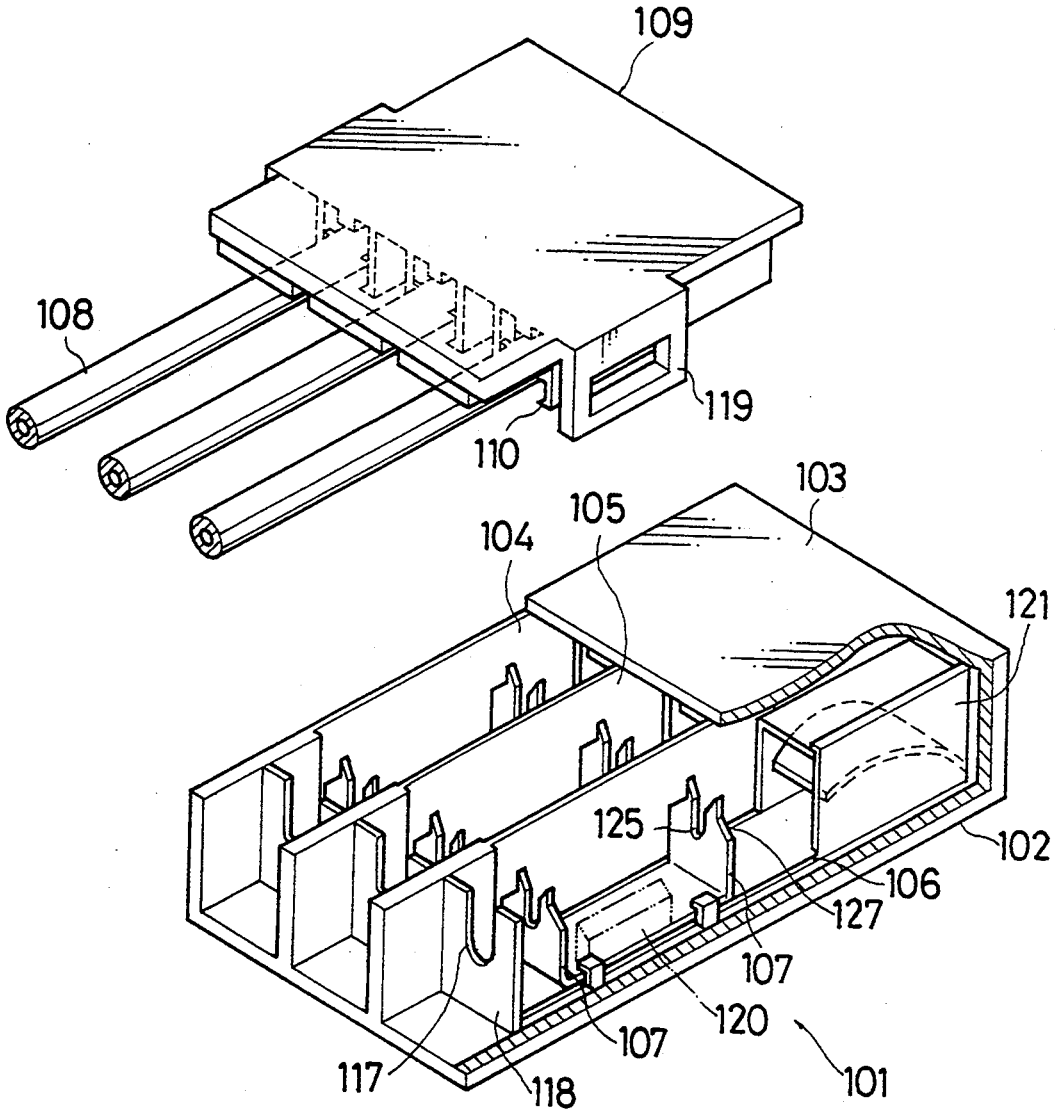
FIG. 6 is an exploded perspective view showing the second embodiment of the pressure welding connector regarding the present invention.
Figure 7:
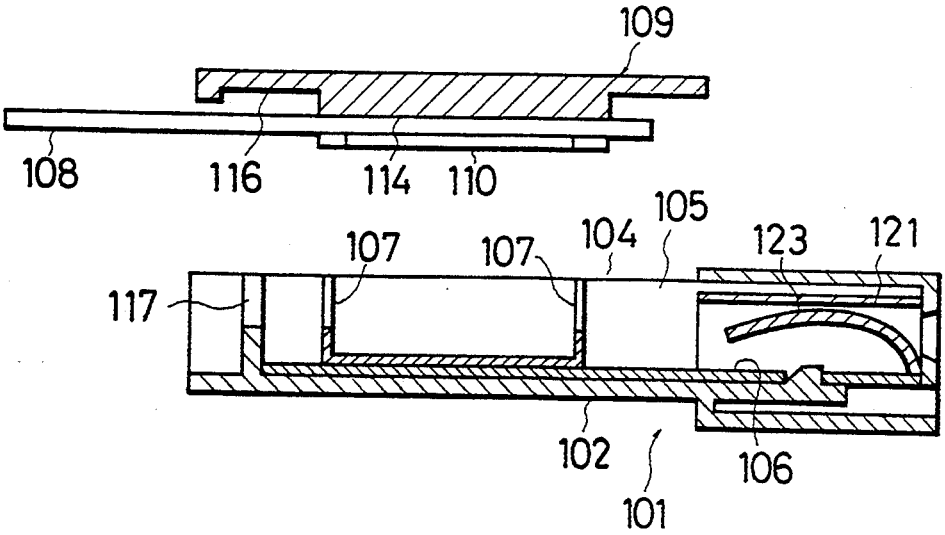
FIG. 7 is a vertical sectional view showing the pressure welding connector of FIG. 6.

FIG. 6 is an exploded perspective view showing second embodiment of a pressure welding connector regarding the present invention. FIG. 7 is a vertical sectional view as the same.

The pressure welding connector 101 has a connector housing 102 which is made of synthetic resin. An opening portions 104 is disposed on rear half of a ceiling 103 of the connector housing 102. The housing 102 has an accommodating chamber 105 for accommodating a connecting terminal 106 therein. A pressure welding terminal 107 of the connecting terminal 106 is positioned in the opening portion 104. By putting a cover 109 over the opening portion 104, it is possible to insert the wire 108 into the pressure welding terminal 107 and to securely connect them to each other by pressure welding.

Figure 8:
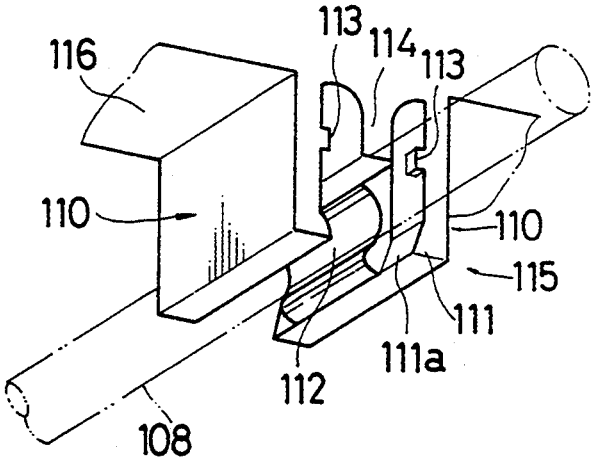
FIG. 8 is a perspective view showing an electric wire holding portion of a cover illustrated in FIG. 6.

That is, as shown in FIG. 8, a pair of flexible holding pieces 110,110 are integrally formed on an inner wall. surface 116 of the cover 109, The flexible holding pieces 110, 110 extend downwardly in a direction perpendicular to the cover 109. The wire 108 is inserted into the pressure welding terminal 107 and held before and after pressure welding by the holding piece 110. Each holding piece 110 is flexible in a direction crossing to the axis of the wire 108 and has a nail portion 111 on the inner side thereof. The nail portion 111 have an inclined surface 111*a* at the inner tip.

The wires 108 are held by a pair of holding walls 112 which protrude from the center of the inner surface of the holding pieces 110. A pair of clip holding protrusions 113 are disposed in the center of the inner ends of the holding pieces 110, 110. The clip holding protrusions 113 are of a rectangular shape and face each other. A wire pressing piece 114 is disposed in the center of a pair of the holding pieces 110, 110. The wire pressing piece 114 downwardly extends from the inner wall surface 116 of the cover 109 in a direction perpendicular to the inner wall surface 116 by a length longer than the position of the clip holding protrusion 113. The plurality of wire holding portions 115 (including holding pieces 110 and pressing piece 114) are placed in line on the cover's inner wall surface 116 corresponding to the position of the pressure welding terminals 107 of the housing 102.

Partition wall 118 is integrally formed with a rear portion of the accommodating chamber of the housing 102. The partition wall 118 has a wire insertion slot 117. Engaging protrusion 120 is disposed on an outer wall of the housing 102. The engaging protrusion 120 engages an engaging frame portion 119 of the cover 109.

The pressure welding terminal 107 is integrally formed with the connect terminal 106. An electrical contact portion 121 is disposed on a tip of the connect terminal 106.

Figure 9:
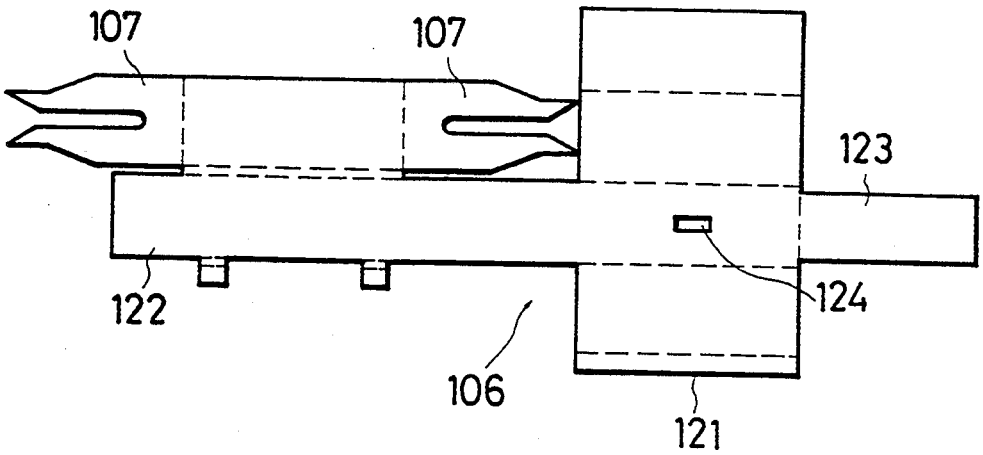
FIG. 9 is a development showing the pressure welding terminals 9 Illustrated in FIG. 6.
Figure 10:
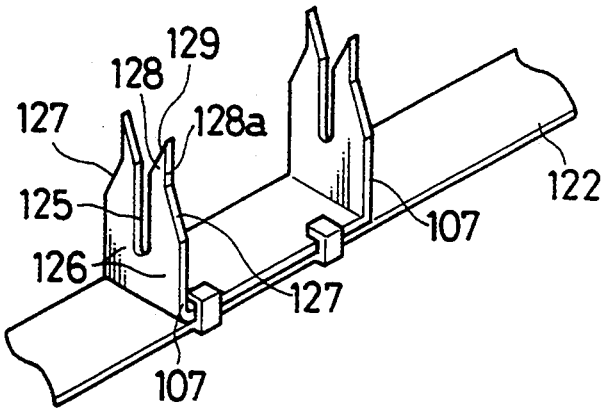
FIG. 10 is an expanded sectional view showing pressure welding terminals illustrated in FIG. 6.

FIG. 9 is a development of the connect terminal 106. FIG. 10 is a expanded view of the pressure welding terminal 107.

As shown in FIGS. 9, 10, a pair of pressure welding terminals 107 are integrally formed on base portion 122 of the connecting terminal 106. One pressure welding terminal is positioned on a front end facing the other terminal which is positioned on the rear end. The electrical contact portion 121 has a spring piece 123 and an engagement hole 124 in the center thereof. The spring piece 123 and the engagement hole 124 are capable of connecting with a matching male terminal (not shown).

As shown in FIG. 10, inclined guide portions 127, 127 are disposed on the outer surface of a pair of the pressure welding pieces 126, 126 on both sides of a slit 125. The inclined guide portions 127, 127 have an are in upwardly tapered shape and face the flexible holding pieces 110, 110. A peak portion 128 is formed at the tip of the pressure welding piece 126. The peak portion 128 has an engaging surface 128*a* which is perpendicular to the clip holding protrusions 113 of the holding piece 110. An inclined pressure welding blade 129 is disposed on the inner side of the peak portion 128.

Figure 11:
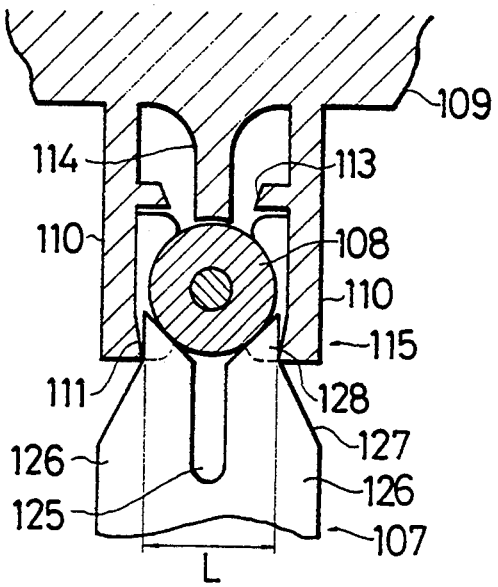
FIG. 11 is a vertical sectional view showing a condition in which pressure-welding wires to the pressure welding terminals illustrated in FIG. 6.

As shown in FIG. 11, an outer width L of the peak portion 128 is made slightly smaller than the inner width of a nail portions 111 which is disposed on tip of the holding piece 110. The inclined guide portion 127 spreads downwardly. In FIG. 11, the nail portions 111 of the holding piece 110 come in contact with the peak portions 128 of the pressure welding terminal 107, and wire 108 is guided into the pressure welding slot 125.

Figure 12:
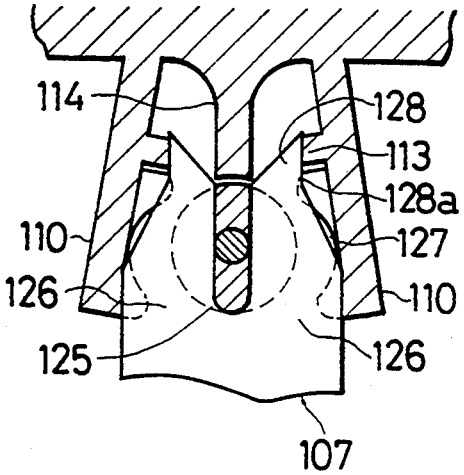
FIG. 12 is a vertical sectional view showing a condition after the pressure-welding illustrated in FIG. 11.

According to closing of the cover 109, the pressing piece 114 presses the wire 108 into the slit 125. At the same time, the holding pieces 110,110 spread outwardly with sliding on the inclined guide portions 127, 127 of the pressure welding terminal 107. Therefore, the clip holding protrusions 113 engage the engaging surface 128*a* of the peak portion of the pressure welding piece 128. Consequently, the pressure welding pieces 126,126 are pressed in a wire clipping direction by the holding piece 110 with stability thereof (see FIG. 12). Therefore, an accurate electrical connection is ensured. Since the clip holding protrusions 113 are disposed on the side of the base end of the holding piece 110, it is possible to provide strong pressing force (stability). It is also possible to provide the maximum wire holding force because the clip holding protrusion 113 presses the peak portion 128 of the pressure welding piece 126.

What is claimed is:

1. A pressure welding connector for use in pressure-welding a wire comprising;

a housing having a terminal receiving portion;

a pressure welding terminal mounted on said terminal receiving portion and having an expanded portion and a press fit slot said expansion portion being to receive said wire and said press fit slot electrically connected with said wire by press-fitting temporary holding means for temporarily holding said wire before press-fitting and having a flexible portion for temporarily holding said wire; and a cover mounted on said terminal receiving portion;

wherein said temporary holding means includes a temporary wire holding portion formed on said cover, said temporary wire holding portion having a pair of flexible pieces, a wire pressing portion and a terminal clip holding portion, said flexible piece extending from said cover, said wire pressing portion inwardly protruded at a center of said flexible piece; and wherein said pressure welding terminal further includes a pair of top portions and a pair of inclined guide portions, said top portions being capable of inserting between said pair of flexible pieces and said wire, said inclined guide portions elastically spreading said flexible pieces by inserting said top portions between said flexible pieces and said wire to make the top portion being received inward pressing force by said wire pressing portion.

2. A pressure welding connector for use in pressure-welding wires comprising:

a housing having a terminal receiving portion;

a pressure welding terminal disposed on said terminal receiving portion of said housing and including a pressure welding portion having a pair of pressure welding pieces and a press-fitting slot, said pairs of pressure welding pieces having a pair of inclined edges to receive said wires, said press-fining slot electrically connected with said wire by press-fitting said wires between said pressure welding pieces; and a cover including a main body and a temporary wire holding portion, said main body being disposed over said terminal receiving portion, said temporary wire holding portion temporarily holding said wires and having a pair of flexible pieces, a wire pressing portion and a terminal clip holding portion, said flexible pieces extending from said main body, said wire pressing portion being protruded at a center of each said flexible piece, said terminal clip holding portions being disposed on an inner surface of said flexible piece;

wherein said each pressure welding piece has a top portion which is capable of being inserted between a pair of said flexible pieces and said wires, said pressure welding terminal further having an inclined guide portion, said inclined guide portion elastically spreading said flexible pieces by inserting the top portion of said pressure welding piece between said flexible pieces and said wires so as to make said top portion inwardly pressed by said wire pressing portion.

* * * * *